US007286121B2

(12) United States Patent
Duggan et al.

(10) Patent No.: US 7,286,121 B2
(45) Date of Patent: Oct. 23, 2007

(54) SUB-COMPONENT BASED RENDERING OF OBJECTS HAVING SPATIAL FREQUENCY DOMINANCE PARALLEL TO THE STRIPING DIRECTION OF THE DISPLAY

(75) Inventors: Michael J. Duggan, Kirkland, WA (US); Beat Stamm, Redmond, WA (US); Geraldine G. Wade, Redmond, WA (US); Greg C. Hitchcock, Woodinville, WA (US)

(73) Assignee: Microsoft Corporation, Redmond, WA (US)

( * ) Notice: Subject to any disclaimer, the term of this patent is extended or adjusted under 35 U.S.C. 154(b) by 518 days.

(21) Appl. No.: 10/745,204

(22) Filed: Dec. 23, 2003

(65) Prior Publication Data

US 2005/0134616 A1 Jun. 23, 2005

(51) Int. Cl.
*G09G 5/00* (2006.01)

(52) U.S. Cl. ..... 345/204; 345/468; 345/470; 345/614

(58) Field of Classification Search ..... 345/87–89, 345/204, 467–469, 471–472.3, 611, 614; 335/98–100

See application file for complete search history.

(56) References Cited

U.S. PATENT DOCUMENTS

| | | | | |
|---|---|---|---|---|
| 6,188,385 | B1 | 2/2001 | Hill et al. | 345/136 |
| 6,219,025 | B1 | 4/2001 | Hill et al. | 345/136 |
| 6,225,973 | B1 | 5/2001 | Hill et al. | 345/136 |
| 6,226,017 | B1 | 5/2001 | Goossen et al. | 345/521 |
| 6,236,390 | B1 | 5/2001 | Hitchcock | 345/149 |
| 6,239,783 | B1 | 5/2001 | Hill et al. | 245/152 |
| 6,243,070 | B1 | 6/2001 | Hill et al. | 345/136 |
| 6,278,434 | B1 | 8/2001 | Hill et al. | 345/127 |
| 6,282,327 | B1 | 8/2001 | Betrisey et al. | 382/299 |
| 6,307,566 | B1 | 10/2001 | Hill et al. | 345/613 |
| 6,339,426 | B1 | 1/2002 | Lui et al. | 345/467 |
| 6,342,890 | B1 | 1/2002 | Shetter | 345/467 |
| 6,342,896 | B1 | 1/2002 | Shetter et al. | 345/589 |
| 6,356,278 | B1 | 3/2002 | Stamm et al. | 345/611 |
| 6,360,023 | B1 | 3/2002 | Betrisey et al. | 382/260 |
| 6,377,262 | B1 | 4/2002 | Hitchcock et al. | 345/467 |
| 6,393,145 | B2 | 5/2002 | Betrisey et al. | 382/162 |
| 6,396,505 | B1 | 5/2002 | Lui et al. | 345/613 |
| 6,421,054 | B1 | 7/2002 | Hill et al. | 345/469 |

(Continued)

OTHER PUBLICATIONS

Legibility of Words Rendered Using Cleartype Thomas R. Aten, Leo Gugerty & Richard A. Tyrrell 2001.

(Continued)

*Primary Examiner*—Lun-Yi Lao
(74) *Attorney, Agent, or Firm*—Workman Nydegger

(57) ABSTRACT

Mechanisms for rendering an object on a portion of a display that includes pixel sub-components for each pixel. The pixel sub-components are striped along a certain direction (e.g., vertically or horizontally). The computing system determines that the object has spatial frequency dominance a direction which happens to be parallel to the striping direction. The computing system then performs sub-component based sampling assuming that the striping direction is perpendicular to the actual striping direction. Then the object is rendered on the display. This may be performed for each object to be displayed. Counterintuitively, this improves the resolution of the character being displayed as compared to performing pixel sub-component based sampling assuming that the striping direction is the same as the actual striping direction.

43 Claims, 9 Drawing Sheets

U.S. PATENT DOCUMENTS

| | | | | |
|---|---|---|---|---|
| 6,542,161 | B1 * | 4/2003 | Koyama et al. | 345/589 |
| 6,577,291 | B2 | 6/2003 | Hill et al. | 345/89 |
| 6,597,360 | B1 | 7/2003 | Stamm et al. | 345/469 |
| 6,624,828 | B1 | 9/2003 | Dresevic et al. | 345/771 |
| 2002/0186229 | A1 * | 12/2002 | Brown Elliott | 345/649 |

OTHER PUBLICATIONS

Cleartype, Cooltype: The Eyes Have it James Felici vol. 4, No. 8 Apr. 2000.

* cited by examiner

SUB-COMPONENT BASED RENDERING OF OBJECTS HAVING SPATIAL FREQUENCY DOMINANCE PARALLEL TO THE STRIPING DIRECTION OF THE DISPLAY

BACKGROUND OF THE INVENTION

1. The Field of the Invention

The present invention relates to rendering of objects on a display; and more specifically, to the display of such objects such that a pixel of the display may represent information from multiple sample points of the object for improved resolution.

2. Background and Related Art

Computing technology has transformed the way we work and play. Computing systems now take a wide variety of forms including desktop computers, laptop computers, tablet PCs, Personal Digital Assistants (PDAs), and the like. Even household devices (such as refrigerators, ovens, sewing machines, security systems, and the like) have varying levels of processing capability and thus may be considered computing systems. As time moves forward, processing capability may be incorporated into a number of devices that traditionally did not have processing capability. Accordingly, the diversity of computing systems may likely increase.

Almost all computing systems that interface with human beings use a display to convey information using the user's sense of sight. In many cases, the appeal of the display is considered an important attribute of the computing system. Color displays in particular are quite appealing to users.

Displays are typically composed of picture elements called "pixels". For color displays, each pixel includes a number of pixel sub-components, each capable of emitting a particular color. For example, most Liquid Crystal Displays (LCDs) have pixels that have an RGB color configuration. In other words, each pixel includes a red pixel sub-component capable of emitting only red light at varying intensities, a green pixel-subcomponent capable of emitting only green light at varying intensities, and a blue pixel sub-component capable of emitting only blue light at varying intensities.

When the display is viewed at a normal viewing distance, the light emitted from the pixel sub-components of a given pixel appears additive to the human viewer. If each pixel sub-component for a pixel has minimum intensity, the pixel appears black. If each pixel sub-component for a pixel has maximum intensity, the pixel appears white. By varying the emission intensities of the pixel sub-components, the pixel may be perceived as having any one of potentially even millions of possible colors.

Liquid Crystal Displays (LCDs) are gaining favor and thus will now be described in further detail. FIG. 1A illustrates a known LCD screen 100 comprising a plurality of rows (R1-R12) and columns (C1-C16). Each row/column intersection forms a square which represents one pixel. FIG. 1B illustrates the upper left hand portion of the known display 100 in greater detail.

Note in FIG. 1B how each pixel element, e.g., the (R2, C1) pixel element, comprises three distinct sub-elements or sub-components, a red sub-component 106, a green sub-component 107 and a blue sub-component 108. Each known pixel sub-component 106, 107, 108 is one third (or approximately one third) the width of a pixel while being equal (or approximately equal) in height to the height of a pixel. Thus, when combined, the three ⅓ width pixel sub-components 106, 107, 108 form a single pixel element.

As illustrated in FIG. 1A, one known arrangement of RGB pixel sub-components 106, 107, 108 form what appear on close inspection to be vertical color stripes down the display 100. Accordingly, the arrangement of one third width color sub-components 106, 107, 108, in the known manner illustrated in FIGS. 1A and 1B, is sometimes called "vertical striping".

Another arrangement of RGB pixel sub-components form horizontal striping as illustrated in the display 200 in FIG. 2. The display 200 also comprises a plurality of rows (r1-r12) and columns (c1-c16). Each row/column intersection also forms a square which represents one pixel. However, in this horizontal striping configuration, each pixel sub-component for a corresponding pixel is one third (or approximately one third) the height of a pixel while being equal (or approximately equal) in width to the width of a pixel. While only 12 rows and 16 columns of pixels are shown in FIGS. 1A, 1B and 2 for purposes of illustration, most LCD displays will include many more rows and many more columns of pixels.

Traditionally, a pixel represents one distinct sample point for an object being displayed. The color for a pixel is determined by sampling the color of the object at a single point. The corresponding pixel sub-components then emit the appropriate intensities to give the overall pixel its appropriate sampled color. As expected, the resolution of the displayed object corresponds one-to-one to the pixel resolution.

In some cases, this resolution will be sufficient. In many cases, however, it is desirable for the image resolution not to be restricted by the pixel resolution. For example, small objects such as text or other characters may have features that are smaller than a single pixel. One technology that improves image resolution of such objects beyond the pixel resolution involves sampling from different portions of the image for each pixel sub-component, even for pixel sub-components belonging to the same pixel. Each pixel sub-component may represent information derived from multiple im age sample points. This type of sampling will be referred to as "pixel sub-component based sampling" regardless of whether the pixel sub-component represents information from one sample point or more than one sample points.

Using pixel sub-component based sampling, each pixel sub-component represents information from different portions of the object being rendered. Therefore, resolution is improved in the direction opposite the striping direction. For example, in LCD displays that use vertical striping, resolution is improved in the horizontal direction.

In vertically striped displays using pixel sub-component based sampling, objects having spatial frequency dominance in the horizontal direction are represented particularly well. Horizontal "spatial frequency dominance" when attributed to an object means that the object tends to have more vertically-oriented components than horizontally-oriented components. Vertical "spatial frequency dominance" when attributed to an object means that the object tends to have more horizontally-oriented components than vertically-oriented components.

Most Latin-based characters have varying degrees of horizontal spatial frequency dominance. For example, the capital letter "I" and the number "1" and the lowercase letter "m" are dominated almost entirely by vertical components. Other Latin-based characters have some horizontal components but are still dominated by vertical components such as, for example, the capital letters "H" or "A". However, not all Latin-based characters have horizontal spatial frequency dominance. A few have vertical spatial frequency dominance. For example, the dash or subtraction "–" symbol and the number sign "#" symbol are dominated by horizontal components. Accordingly, conventional pixel sub-component based sampling renders many Latin-based characters quite well when rendered on a vertically striped display.

Although Latin-based characters have predominantly horizontal spatial frequency dominance, many alphabets throughout the world have different degrees of horizontal and vertical spatial frequency dominance. For example, Chinese-based pictographs (i.e., pictographs of Chinese origin such as Kanji and other East Asian characters) more often have vertical spatial frequency dominance (or at least tend to have less horizontal spatial frequency dominance) in that they tend to have more horizontally-oriented strokes than do Latin-based characters. Accordingly, conventional sub-component based sampling results in better quality rendering on a vertically-striped display for objects such as Latin characters tending more towards horizontal spatial frequency dominance than it does for objects such as Chinese based pictographs having less horizontal spatial frequency dominance or even vertical spatial frequency dominance.

Therefore, what would be advantageous are mechanisms in which sub-component based sampling may be used to better render objects having a spatial frequency dominance that is parallel to the striping direction of the display.

BRIEF SUMMARY OF THE INVENTION

The foregoing problems with the prior state of the art are overcome by the principles of the present invention, which are directed towards mechanisms for rendering an object on a portion of a display that includes pixel sub-components for each pixel. The pixel sub-components are striped along a certain direction (e.g., vertically or horizontally). The mechanism results in improved resolution due to sub-component based sampling even though the object being rendered has spatial frequency dominance in a direction parallel to the striping direction of the display. For example, using the principles of the present invention, Latin-based characters may be displayed with improved resolution (as compared to conventional rendering techniques) on displays that have horizontal striping even though Latin-based characters are predominated by more vertical components (i.e., have horizontal spatial frequency dominance). On the other hand, many Chinese-based pictographs which are predominated by horizontal strokes (i.e., have vertical spatial frequency dominance) may be displayed with improved resolution on displays that have vertical striping using the principles of the present invention.

The object to be displayed may be a text character or non-text character. Regardless, for the object to be displayed, the computing system determines that the object has spatial frequency dominance in a direction which happens to be parallel to the striping direction. For example, a particular Chinese character has many horizontal strokes and thus has vertical spatial frequency dominance. The display also happens to be vertically striped although the striping direction may not necessarily be known to the computing system.

The computing system then performs pixel sub-component based sampling assuming that the striping direction is perpendicular to the actual striping direction. For example, when rendering a character of Chinese origin that has vertical spatial frequency dominance on a vertically striped display, the computing system performs pixel sub-component based sampling as though the object was going to be displayed on a horizontally-striped display. This may be accomplished by rotating a representation of the object ninety degrees, performing pixel sub-component based sampling on the rotated representation as though the object were going to be rendered on a vertically-striped display, and then rotates back ninety degrees the sampled representation of the object. Such rotation is just an example of how pixel sub-component based sampling may occur while assuming that the striping direction is perpendicular to the actual striping direction. In other algorithms, rotation is not necessary.

Then the object is rendered on the display. This may be performed for each object to be displayed. If the next adjacent object has a different spatial frequency dominance, then the pixel sub-component based sample may be performed assuming the same striping direction as the actual striping direction of the display. Accordingly, the analysis and sampling may be performed per object, thereby optimizing the rendering for each object, regardless of the spatial frequency dominance of each individual object.

Additional features and advantages of the invention will be set forth in the description that follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1A:
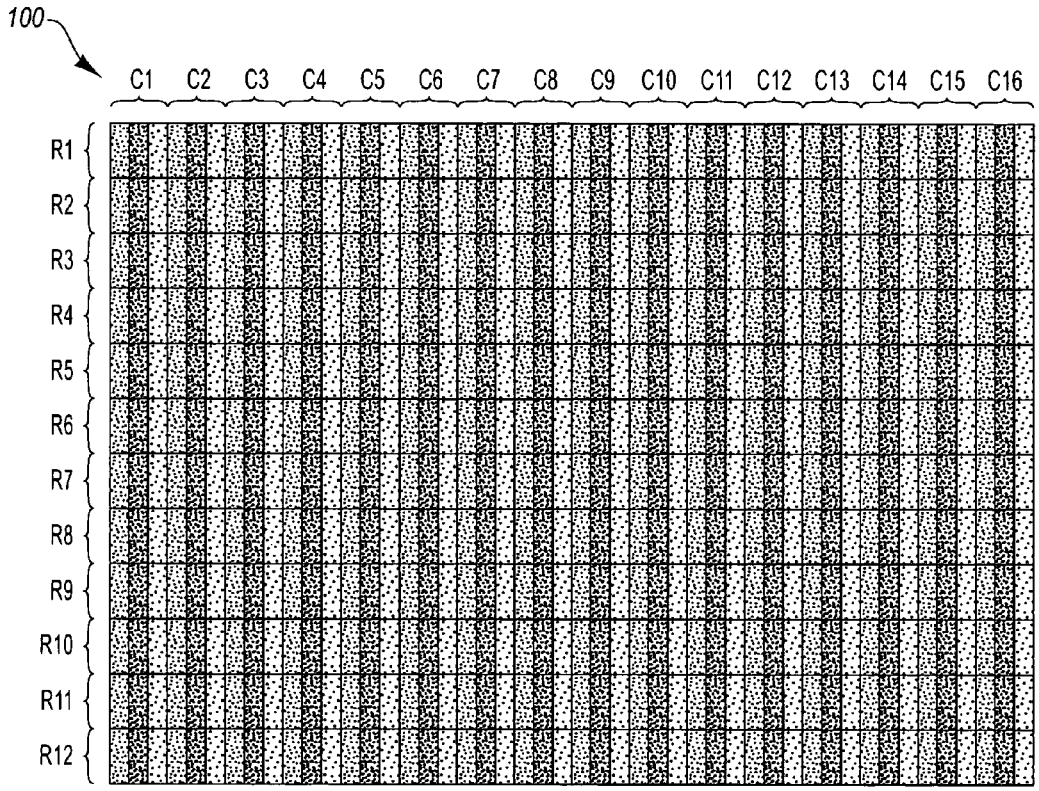
Fig. 1A (Prior Art)
FIG. 1A illustrates a display with vertical striping in accordance with the prior art.
Figure 1B:
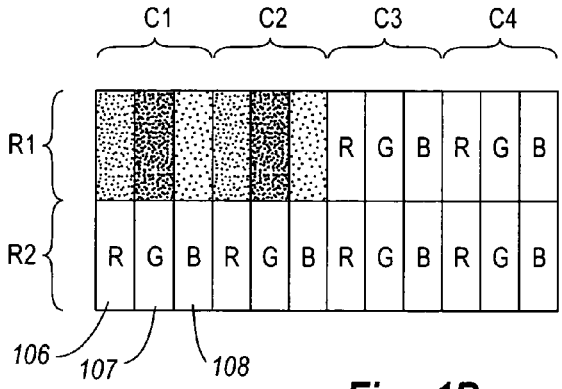
Fig. 1B (Prior Art)
FIG. 1B illustrates a portion of the vertically-striped display of FIG. 1A.

The principles of the present invention relate to mechanisms for rendering an object on a portion of a display that includes pixel sub-components for each pixel. The pixel sub-components are striped along a certain direction (e.g., vertically or horizontally). The mechanism results in improved resolution due to sub-component based sampling even though the object has spatial frequency dominance in the same direction as the striping direction. The computing system determines that the object has spatial frequency dominance in a direction which happens to be parallel to the striping direction. The computing system then performs sub-component based sampling assuming that the striping direction is perpendicular to the actual striping direction. Counterintuitively, this improves the resolution of the object being displayed as compared to performing pixel sub-component based sampling assuming that the striping direction is the same as the actual striping direction of the display. Then the object is rendered on the display. This may be performed for each object to be displayed.

If the next adjacent object has a different spatial frequency dominance that is perpendicular to the actual striping direction, then the pixel sub-component based sample may be performed assuming the same striping direction as the actual striping direction of the display. Accordingly, the analysis and sampling may be performed per object, thereby optimizing the object rendering for each object.

Turning to the drawings, wherein like reference numerals refer to like elements, the invention is illustrated as being implemented in a suitable computing environment. The following description is based on illustrated embodiments of the invention and should not be taken as limiting the invention with regard to alternative embodiments that are not explicitly described herein.

In the description that follows, the invention is described with reference to acts and symbolic representations of operations that are performed by one or more computers, unless indicated otherwise. As such, it will be understood that such acts and operations, which are at times referred to as being computer-executed, include the manipulation by the processing unit of the computer of electrical signals representing data in a structured form. This manipulation transforms the data or maintains them at locations in the memory system of the computer, which reconfigures or otherwise alters the operation of the computer in a manner well understood by those skilled in the art. The data structures where data are maintained are physical locations of the memory that have particular properties defined by the format of the data. However, while the invention is being described in the foregoing context, it is not meant to be limiting as those of skill in the art will appreciate that several of the acts and operations described hereinafter may also be implemented in hardware.

For descriptive purposes, the architecture portrayed is only one example of a suitable environment and is not intended to suggest any limitation as to the scope of use or functionality of the invention. Neither should the computing systems be interpreted as having any dependency or requirement relating to anyone or combination of components illustrated in FIG. 3.

The invention is operational with numerous other general-purpose or special-purpose computing or communications environments or configurations. Examples of well known computing systems, environments, and configurations suitable for use with the invention include, but are not limited to, mobile telephones, pocket computers, personal computers, servers, multiprocessor systems, microprocessor-based systems, minicomputers, mainframe computers, and distributed computing environments that include any of the above systems or devices.

Figure 3:
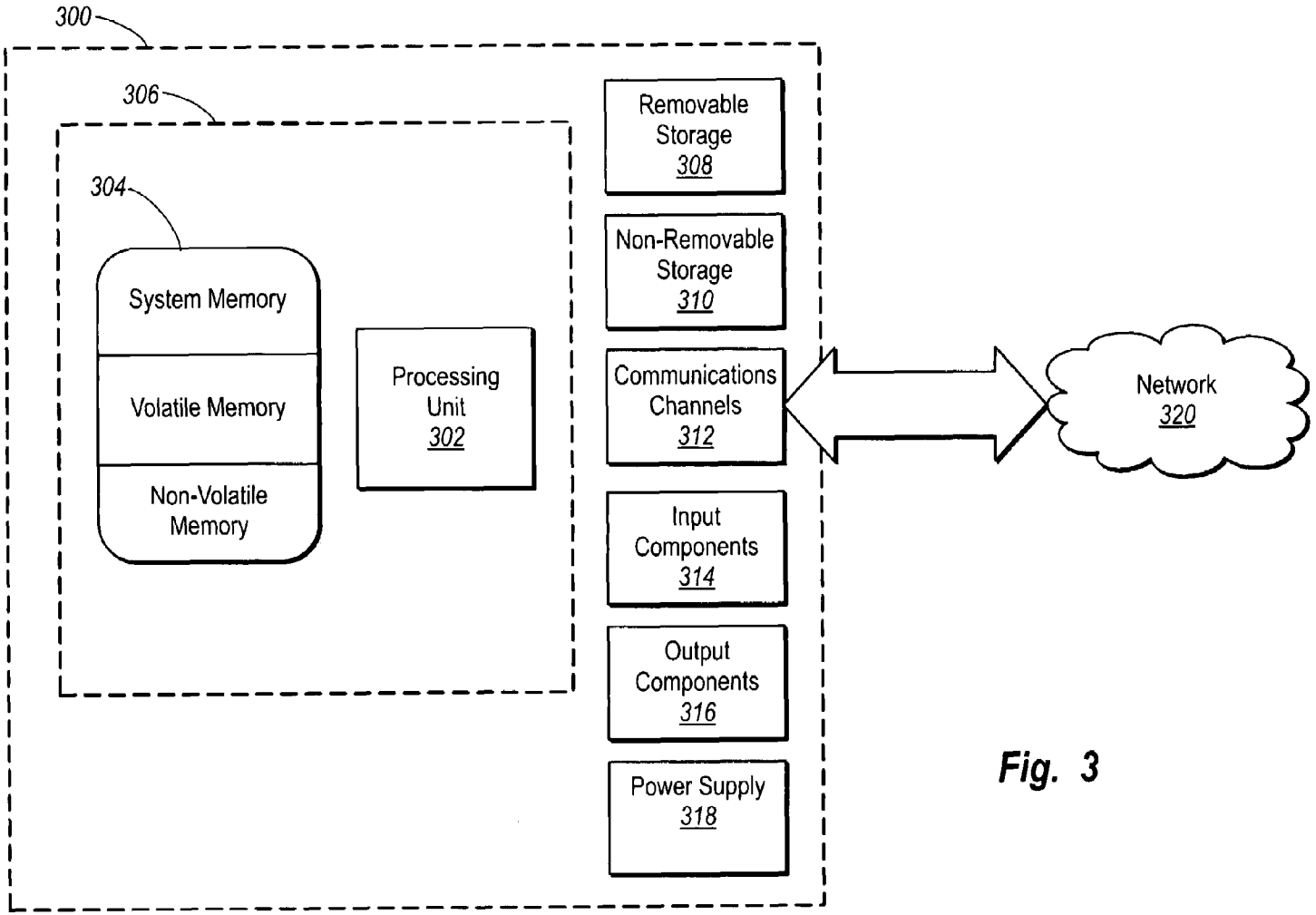
FIG. 3 illustrates a suitable computing environment including a display onto which objects may be rendered in accordance with the principles of the present invention.

In its most basic configuration, a computing system 300 typically includes at least one processing unit 302 and memory 304. The memory 304 may be volatile (such as RAM), non-volatile (such as ROM, flash memory, etc.), or some combination of the two. This most basic configuration is illustrated in FIG. 3 by the dashed line 306.

The storage media devices may have additional features and functionality. For example, they may include additional storage (removable and non-removable) including, but not limited to, PCMCIA cards, magnetic and optical disks, and magnetic tape. Such additional storage is illustrated in FIG. 3 by removable storage 308 and non-removable storage 310. Computer-storage media include volatile and non-volatile, removable and non-removable media implemented in any method or technology for storage of information such as computer-readable instructions, data structures, program modules, or other data. Memory 304, removable storage 308, and non-removable storage 310 are all examples of computer-storage media. Computer-storage media include, but are not limited to, RAM, ROM, EEPROM, flash memory, other memory technology, CD-ROM, digital versatile disks, other optical storage, magnetic cassettes, magnetic tape, magnetic disk storage, other magnetic storage devices, and any other media that can be used to store the desired information and that can be accessed by the computing system.

As used herein, the term "module" or "component" can refer to software objects or routines that execute on the computing system. The different components, modules, engines, and services described herein may be implemented as objects or processes that execute on the computing system (e.g., as separate threads). While the system and methods described herein are preferably implemented in software, implementations in software and hardware or hardware are also possible and contemplated.

Computing system 300 may also contain communication channels 312 that allow the host to communicate with other systems and devices. Communication channels 312 are examples of communications media. Communications media typically embody computer-readable instructions, data structures, program modules, or other data in a modulated data signal such as a carrier wave or other transport mechanism and include any information-delivery media. By way of example, and not limitation, communications media include wired media, such as wired networks and direct-wired connections, and wireless media such as acoustic, radio, infrared, and other wireless media. The term computer-readable media as used herein includes both storage media and communications media.

The computing system 300 may also have input components 314 such as a keyboard, mouse, pen, a voice-input component, a touch-input device, and so forth. Output components 316 include screen displays, speakers, printer, etc., and rendering modules (often called "adapters") for driving them. The computing system 300 has a power supply 318. All these components are well known in the art and need not be discussed at length here.

Figure 2:
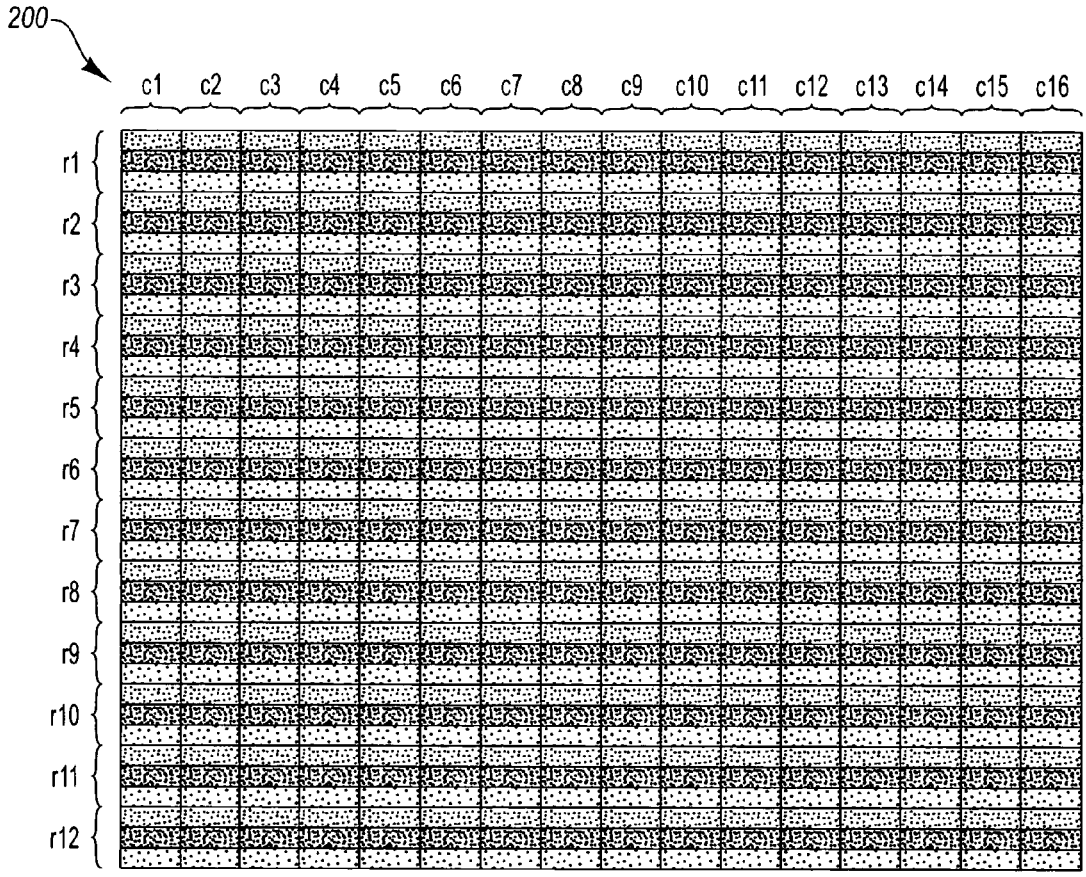
FIG. 2 illustrates a display with horizontal striping in accordance with the prior art.

The display of the computing system 300 may be a Liquid Crystal Display having vertical striping as illustrated with respect to FIG. 1A, or horizontal striping as illustrated with respect to FIG. 2.

Figure 4:
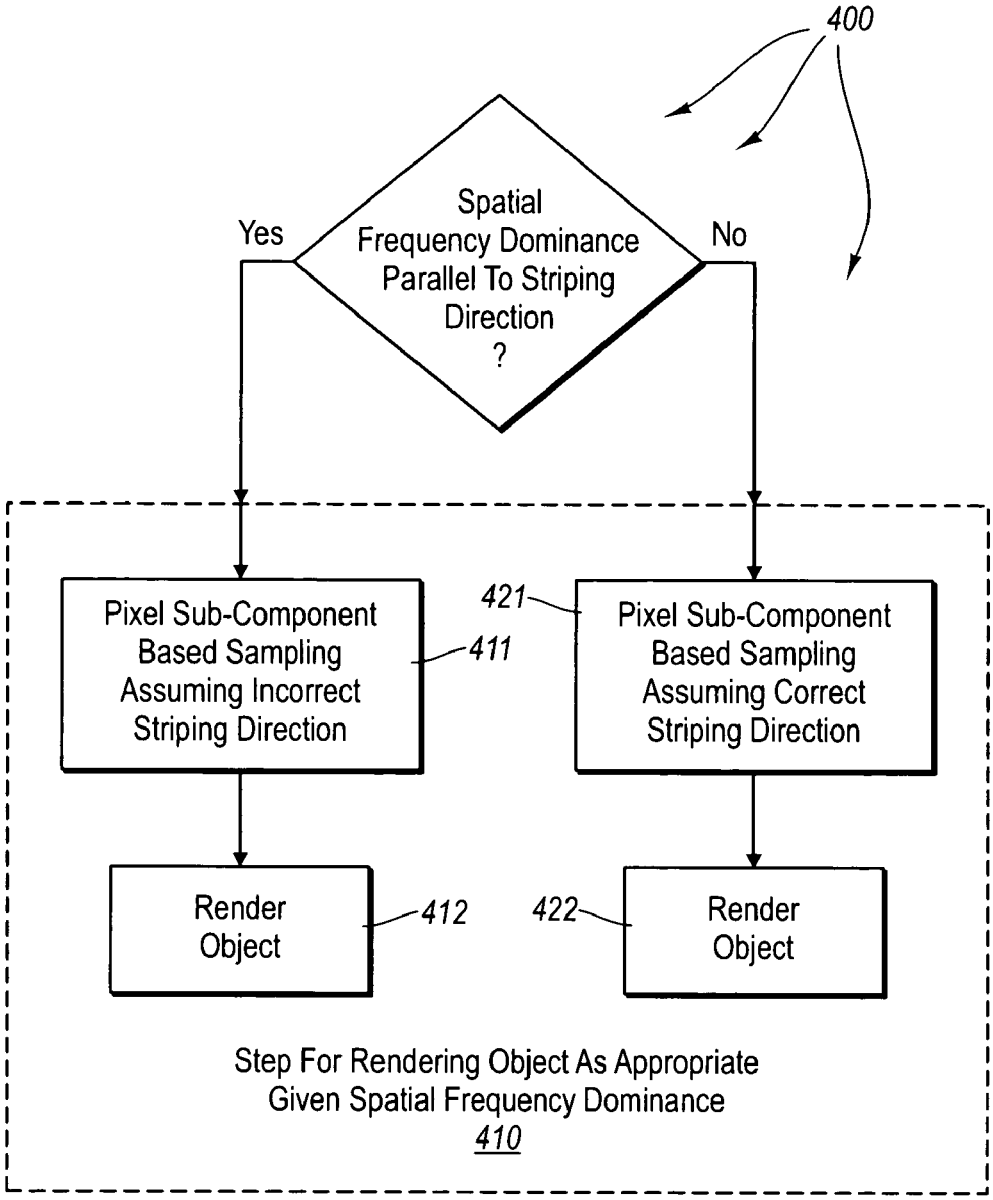
FIG. 4 illustrates a flowchart of a method for rendering objects in accordance with the principles of the present invention.

FIG. 4 illustrates a flowchart of a method 400 for rendering an object on a portion of a display that includes a plurality of pixel sub-components for each pixel, where the pixel sub-components are striped vertically (see FIG. 1A) or horizontally (see FIG. 2). Other striping configurations are suitable for use with the principles of the present invention even if not currently employed. For example, the principles of the present invention may be applied to diagonal striping. The display often would be similarly configured such that all of the pixels in the display were each composed of a plurality of pixel subcomponents having a common striping direction. However, this need not be the case. For example, perhaps only a portion of the display has horizontal or vertical striping. In one example, portions of the display may have pixels striped in one direction (e.g., vertically), while other portions of the same display may have pixels striped in a different direction (e.g., horizontally). The principles of the present invention apply in any of these cases. The object may be non-text objects or may be text characters. The text character might be, for example, a Latin-based text character, an entire pictograph of Chinese origin (i.e., pictographs of Chinese origin such as Kanji and other East Asian characters), or just a radical of the pictograph, or any other text character.

The object may be represented in any manner. For example, the object may be represented using a bitmap, or may be represented using an outline description. The use of outline descriptions is advantageous in that the object may be scaled in a more computationally efficient manner than if the object was represented using a bitmap. The object may also have a description of a color for the object. The color may be uniform, or different for different portions of the object.

The computing system 300 determines that the object has spatial frequency dominance parallel to the actual striping direction (YES in decision block 401). At this stage, the computing system 300 need not have any centralized knowledge of what the actual striping direction is. However, if the actual striping direction of the display is horizontal, this act involves the computing system 300 determining that the object has horizontal spatial frequency dominance (i.e., has more vertically-oriented components). However, if the actual striping direction of the display is vertical, this act involves the computing system 300 determining that the object has vertical spatial frequency dominance (i.e., has more horizontal-oriented components).

This determination may be performed in a number of different manners. For example, the object may have associated with it an identification of whether the object has horizontal spatial frequency dominance or vertical spatial frequency dominance. Alternatively, the object may include an identifier which associates the object with a set of objects (e.g., an alphabet or character set). The computing system 300 may then determine based on the set of objects whether or not the object likely has horizontal or vertical spatial frequency dominance. Alternatively, the computing system 300 may make the determination by examining the topology of the object.

The computing system may apply this determination on an object-by-object bases by making this determination for each object to be rendered. On the other hand, the computing system 300 may make this determination once for one object, and apply the determination results to one or more subsequent objects to be displayed.

If the computing system 300 determines that the object has spatial frequency dominance parallel too the actual striping direction (YES in decision block 401), then the computing system 300 performs a functional, result-oriented step for rendering the object on the display as appropriate given the spatial frequency dominance of the object (step 410). While this step may include any corresponding acts that accomplish the stated result, step 410 includes acts 411, 412, 421 and 422 in the illustrated embodiment.

Specifically, the computing system 300 performs pixel sub-component based sampling assuming that the striping direction is perpendicular to the actual striping direction (act 411). The assumption that the striping direction is perpendicular to the actual striping direction is by definition an incorrect assumption. Nevertheless, counterintuitively, this incorrect assumption results in finer resolution when the object has spatial frequency dominance in the same direction as the striping direction.

Figure 5:
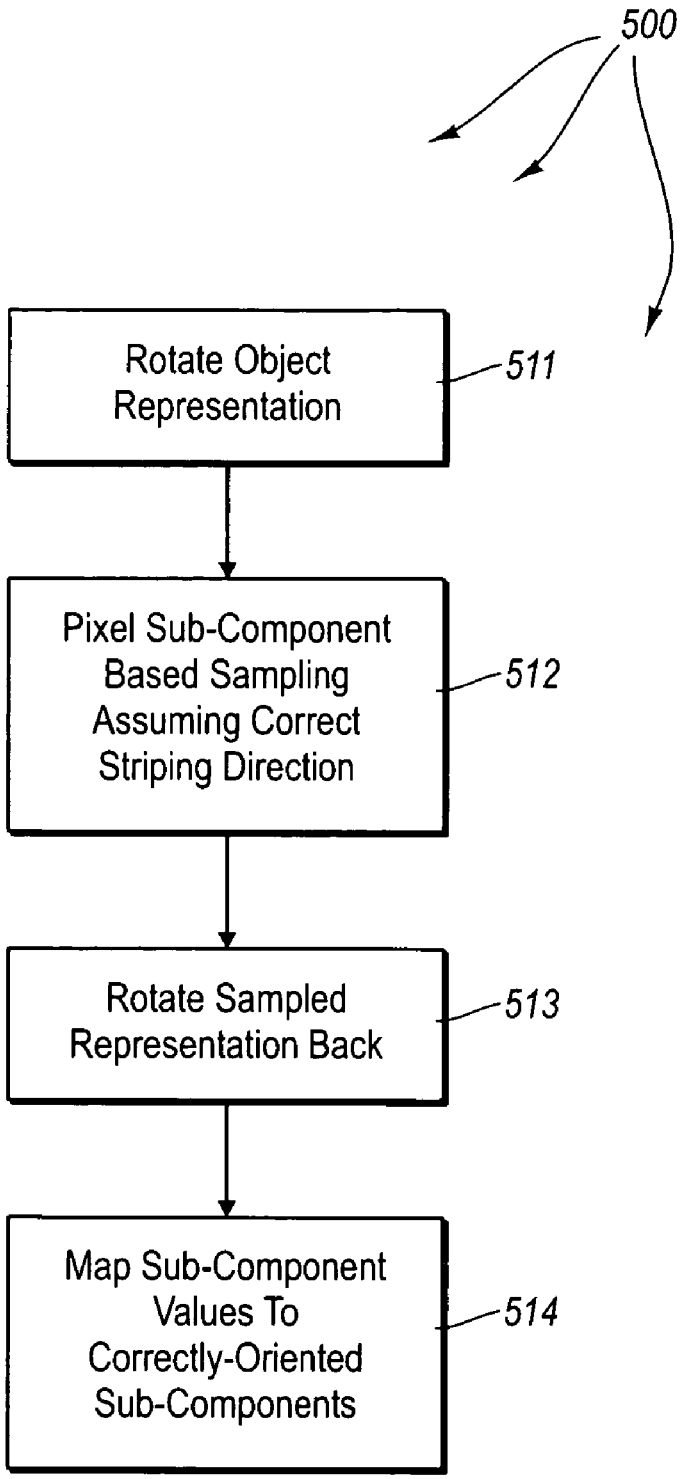
FIG. 5 illustrates a flowchart of a method for performing pixel sub-component based sampling assuming that the striping direction is perpendicular to the actual striping direction of the display in accordance with one embodiment of the principles of the present invention.

FIG. 5 illustrates a flowchart of a method 500 for performing pixel sub-component based sampling assuming that the striping direction is perpendicular to the actual striping direction. The method 500 is one way of performing act 411. First, a representation of the object is rotated (act 511) (See FIG. 6A to 6B). Then, pixel sub-component based sampling is performed on the rotated representation of the object assuming the actual striping direction (act 512) (see FIG. 6C). An example of sub-component based sampling is described in commonly assigned, U.S. Pat. No. 6,188,385 B1 issued Feb. 13, 2001, and entitled "Method and Apparatus for Displaying Images such as Text", the content of which is incorporated herein by reference in its entirety. Then, the sampled representation of the object is rotated back (act 513) (see FIG. 6D). Finally, the sample values from the incorrectly-oriented sub-components are each mapped to a correctly-oriented sub-component (act 514) (see FIG. 6E).

Figure 6A:
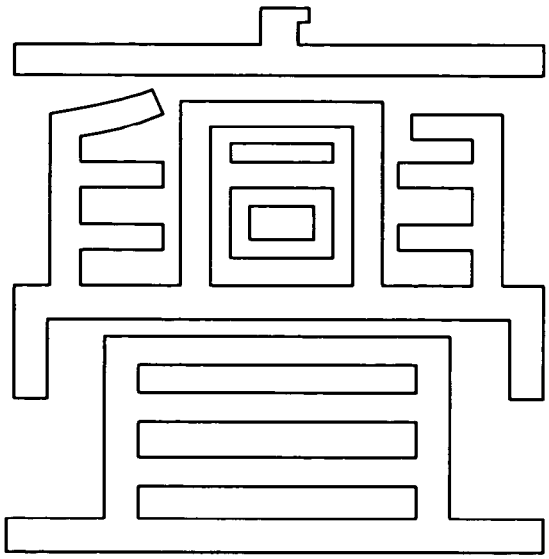
FIG. 6A illustrates a representation of an object of vertical spatial frequency dominance.

The process described with respect to FIG. 5 may best be understood by reference to the specific example flow represented by FIGS. 6A through 6E. FIG. 6A illustrates a representation of an object of vertical spatial frequency dominance. The object is a Japanese Kanji character of Chinese origin. Note the large number of horizontal strokes as compared to the vertical strokes. Suppose in this example that the object is to be rendered on a vertically-striped display. Accordingly, the method 400 would perform pixel sub-component based sampling of the method assuming that the striping direction is horizontal, when it is actually vertical.

Figure 6B:
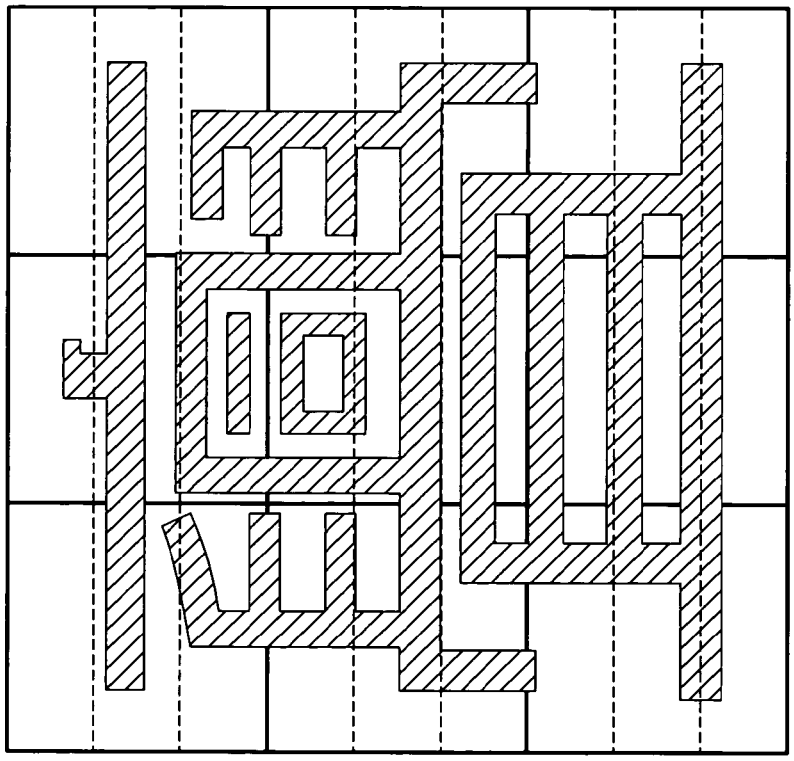
FIG. 6B illustrates the representation of the object rotated ninety degrees counter-clockwise and superimposed upon a grid pattern corresponding to a vertically-striped display.

As mentioned with respect to FIG. 5, one way to accomplish this is to rotate the object, perform pixel sub-component based sampling assuming the correct striping direction, and then rotate the sampled object back to the object's original orientation. FIG. 6B illustrates the representation of the object rotated (and potentially scaled) as superimposed upon a grid pattern representing a vertically-striped display. The grid is represented by a three-by-three array of pixels, each pixel having three vertically-striped sub-components.

Figure 6C:
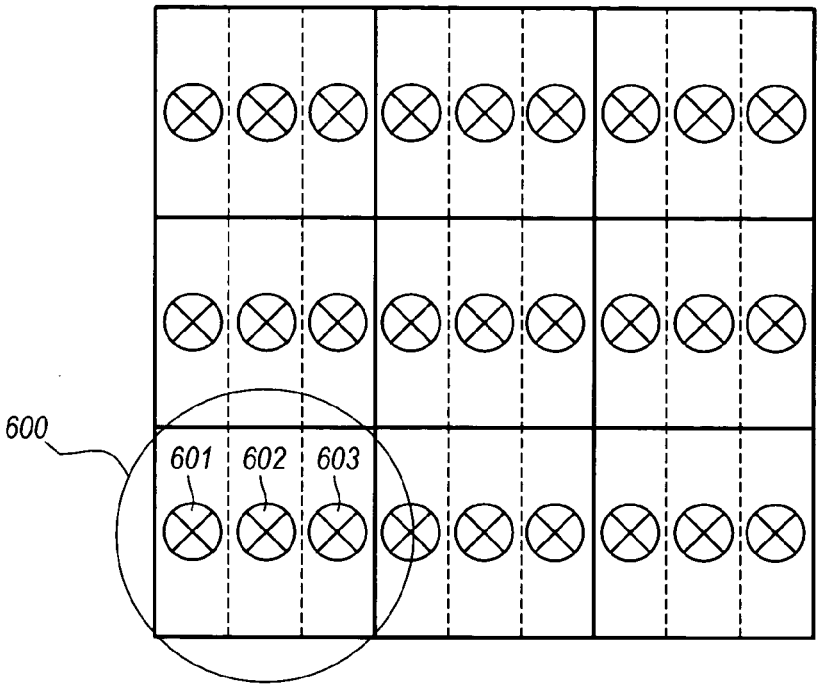
FIG. 6C illustrates the representation of the rotated object after scan conversion using the vertically striped grid pattern in which each pixel sub-component has a sample value represented by a circled X, and in which the samples are vertically striped.

FIG. 3C illustrates the representation of the rotated object after scan conversion using the vertically striped grid in which each pixel sub-component has a sample value. At this juncture, the sampled object is still rotated. The circles marked with the X represent the sampled points that correspond to each pixel sub-component. For example, the lower-left pixel 600 includes sample points 601, 602 and 603. When the sampled object from FIG. 6C is rotated ninety degrees clockwise back to its original orientation illustrated in FIG. 6D, the pixel sub-component samples would have a horizontally-striped orientation if the samples are also rotated. This horizontally-striped orientation of sample points may have been more directly obtained without rotation. For example, the scan conversion may be directly applied to the object of FIG. 6A using a grid having horizontally striped sub-components to obtain the samples shown in FIG. 6D.

Figure 6D:
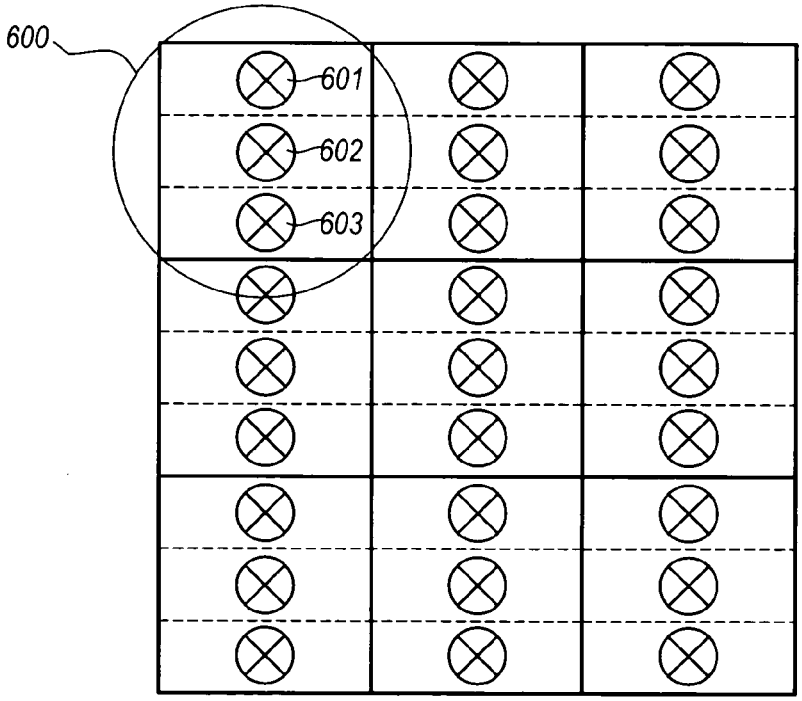
FIG. 6D illustrates the sampled object of FIG. 6C after being rotated back to its original orientation ninety degrees clockwise in which the samples are horizontally striped.
Figure 6E:
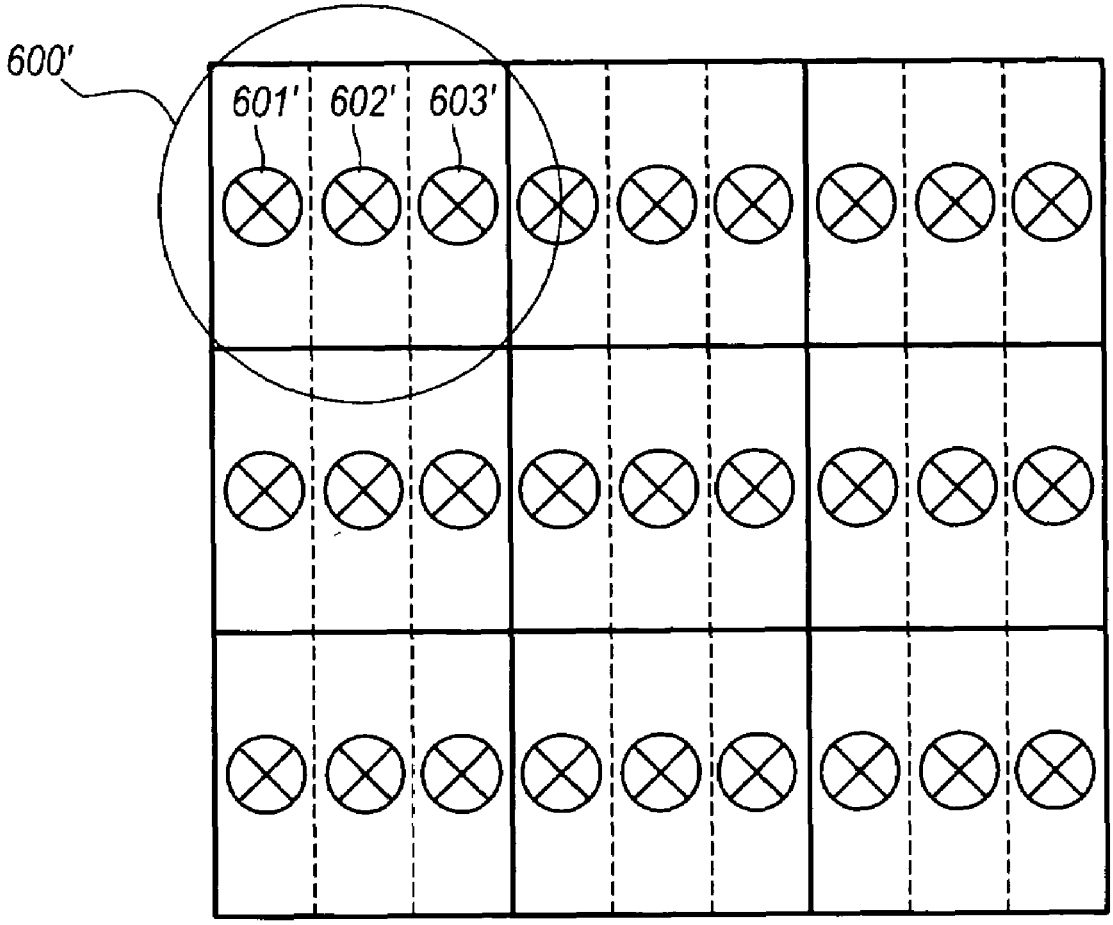
FIG. 6E illustrates the sample representation of the object of FIG. 6D in which the samples are mapped back to sub-components having the correct vertically-striped orientation for the display.

FIG. 6E illustrates the final step in which the sub-component samples are mapped to the correctly-oriented sub-components. FIG. 6E shows that the sub-component samples are now vertically-striped. For each pixel, the horizontally-striped sub-component sample from FIG. 6D is mapped to a vertically-striped sub-component sample in FIG. 6E. For example, for pixel 600, the upper sub-component sample 601 from FIG. 6D is mapped to the left sub-component sample 601' of FIG. 6E, the middle sub-component sample 602 from FIG. 6D is mapped to the middle sub-component sample 602' of FIG. 6E, and the bottom sub-component 603 of FIG. 6D is mapped to the right sub-component sample 603' of FIG. 6E.

When rotation is used to perform pixel sub-component based sampling assuming an incorrect striping direction, one may go directly from the sampled object of FIG. 6C to the sampled object of FIG. 6E by rotating only the pixels, while keeping the orientation of the pixel sub-component sample values within each pixel the same. For example, comparing FIGS. 6C and 6E, pixel 600 is rotated to become pixel 600'. However, the orientation of the pixel sub-component sample values 601, 602 and 603 in the pixel 600 of FIG. 6C is the same as the orientation of the pixel sub-component sample values 601', 602' and 603' in the pixel 600' of FIG. 6E.

Comparing FIGS. 6D and 6E, each of the pixel sub-components in pixel 600 of FIG. 6D is mapped to a pixel sub-component in pixel 600' of FIG. 6E. For example, the upper sub-component sample 601 of the pixel 600 of FIG. 6D may be mapped to the left sub-component sample 601' of pixel 600' of FIG. 6E. Furthermore, the middle sub-component sample 602 of pixel 600 may be mapped to the middle sub-component sample 602' of pixel 600', and the bottom sub-component sample 603 of pixel 600 may be mapped to the right sub-component sample 603' of FIG. 6E. Although this mapping improves resolution, any mapping between the pixel sub-components of pixel 600 of FIG. 6D and the pixel sub-components of pixel 600' of FIG. 6E may suffice to improve resolution.

The fact that the mapping represented between FIGS. 6D and 6E results in improved resolution is quite surprising. This mapping essentially means that a sampled value representing one portion of the image is offset to a different portion of the display than one might expect. One of ordinary skill in the art might actually expect that this would decrease resolution. However, the inventors have discovered that performing this mapping actually improves a human being's perception of the object.

Once the pixel sub-component based sampling is performed using the incorrect striping assumption (act 411), the computing system 300 then renders at least a derivative of the sampled representation of the object on the display (act 412). For example, the sample points from FIG. 6D may be used directly as intensity values during the rendering. Alternative, some other processing may also be performed prior to rendering if so desired.

Returning to decision block 401, if, on the other hand, the computing system 300 determined that an object to be rendered has spatial frequency dominance perpendicular to the actual striping direction (NO in decision block 401), the computing system 300 performs sub-component based sampling assuming the actual striping at the striping direction is parallel to the actual striping direction (act 421). This sub-component based sampling is described in commonly assigned, U.S. Pat. No. 6,188,385 B1 issued Feb. 13, 2001, and entitled "Method and Apparatus for Displaying Images such as Text", the content of which is incorporated herein by reference above. The computing system then renders at least a derivative of the sampled representation of the object on the display (act 422).

Figure 7A:
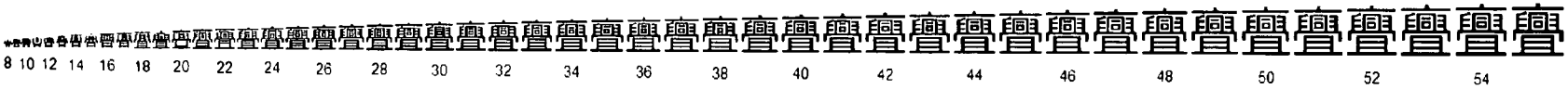
FIG. 7A illustrates the object of vertical spatial frequency dominance when rendered at several font sizes and in which the pixel sub-component based sampling is performed assuming that the striping direction is opposite the actual vertical striping direction of the display.
Figure 7B:
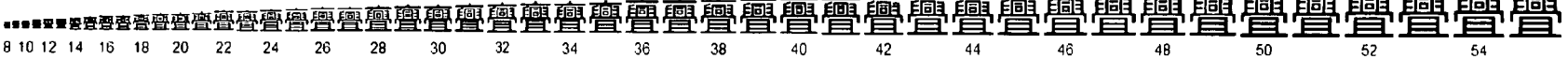
FIG. 7B illustrates the same object of vertical spatial frequency dominancy when rendered at several font sizes and in which the pixel sub-component based sampling is performing assuming that the striping direction is the same as the actual striping direction of the display in accordance with the principles of the present invention.

Counterintuitively, performing the pixel sub-component based sampling assuming the incorrect striping orientation actually results in better resolution. FIG. 7A illustrates the object of vertical spatial frequency dominance when rendered at several font sizes and in which the pixel sub-component based sampling is performed assuming that the striping direction is opposite the actual vertical striping direction of the display. For contrast, FIG. 7B illustrates the object when rendered at several font sizes and in which the pixel sub-component based sampling is performing assuming that the striping direction the same as the actual striping direction. Note the improved resolution especially apparent for smaller font sizes.

Furthermore, as the pixel sub-sampling may be performed for each object, the spatial frequency dominance may be considered for each object, thereby improving resolution for each object.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes, which come within the meaning and range of equivalency of the claims, are to be embraced within their scope.

What is claimed and desired secured by United States Letters Patent is:

1. In a computing system that includes a display device having a plurality of pixels, a method for rendering an object on a portion of the display device that includes a plurality of pixel sub-components for each pixel, the plurality of pixel sub-components having an actual striping direction in a certain direction, the method taking advantage of improved resolution due to sub-component based sampling which takes into account the relationship between the object and the actual striping direction of the display device, the method comprising:

determining through computerized processing that the object has spatial frequency dominance in a first direction;

determining if the first direction of the spatial frequency dominance is parallel to the actual striping direction of the display device;

performing pixel sub-component based sampling such that when the first direction is not parallel to the actual striping direction of the display device, the pixel sub-component based sampling is preformed, for the purposes of sampling, that the striping direction is the actual striping direction of the display device, and when the direction is parallel to the actual striping direction of the display device, the pixel sub-component based sampling is performed, assuming for purposes of sampling, that the striping direction of the display device is perpendicular to the actual striping direction of the display device; and rendering at least a derivative of the sampled representation of the object on the display device having the actual striping direction.

2. A method in accordance with claim 1, wherein the object is a text character.

3. A method in accordance with claim 2, wherein the text character is a pictograph of Chinese origin.

4. A method in accordance with claim 1, wherein the determination of spatial dominance is through an identification associated with the object of whether the object has horizontal spatial frequency dominance or vertical spatial frequency dominance.

5. A method in accordance with claim 1, wherein the determination of spatial dominance is through a computer examining the topology of the object.

6. A method in accordance with claim 1, wherein the object is not a text character.

7. A method in accordance with claim 1, wherein an act of determining that the object has spatial frequency dominance in a first direction comprises the following:

an act of determining that the objects in a set of objects tend to have spatial frequency dominance in the first direction; and an act of determining that the object is one of the objects in the set of objects.

8. A method in accordance with claim 1, wherein the object is a first object, the method further comprising the following:

an act of determining through computerized processing that a second object that is to be displayed adjacent to the first object has spatial frequency dominance in a second direction, wherein the second direction is perpendicular to the actual striping direction of the display device;

an act of performing sub-component based sampling assuming that the striping direction is parallel to the actual striping direction; and an act of rendering at least a derivative of the sampled representation of the second object on the display device having the actual striping direction.

9. A method in accordance with claim 8, wherein the first and second objects are portions of the same Chinese pictograph.

10. A method in accordance with claim 1, wherein the actual striping direction is vertical.

11. A method in accordance with claim 1, wherein the actual striping direction is horizontal.

12. A method in accordance with claim 1, wherein all of the pixels in the display have actual striping in the actual striping direction.

13. A method in accordance with claim 1, wherein the act of performing pixel sub-component based sampling assuming that the striping direction is perpendicular to the actual striping direction comprises the following:

an act of rotating the representation of the object;

an act of performing sub-component based sampling on the rotated representation of the object assuming the actual striping direction; and an act of rotating back the sampled representation of the object.

14. A method in accordance with claim 1, wherein the act of performing pixel sub-component based sampling further comprising the following:

an act of mapping the sampled values to a pixel sub-component.

15. A computer program product for use in a computing system that includes a display device having a plurality of pixels, the computer program product for performing a method for rendering an object on a portion of the display device that includes a plurality of pixel sub-components for each pixel, the plurality of pixel sub-components having an actual striping direction in a certain direction, the method taking advantage of improved resolution due to sub-component based sampling which takes into account the relationship between the object and the actual striping direction of the display device, the computer program product comprising a computer-readable storage media having stored thereon computer-executable instructions that, when executed by the computing system, cause the computing system to perform the method of claim 1.

16. A computer program product in accordance with claim 15, wherein the object is a text character.

17. A computer program product in accordance with claim 16, wherein the text character is a Latin-based text character.

18. A computer program product in accordance with claim 15, wherein the object is a pictograph of Chinese origin.

19. A computer program product in accordance with claim 16, wherein the object is a radical of a pictograph of Chinese origin.

20. A computer program product in accordance with claim 15, wherein the object is not a text character.

21. A computer program product in accordance with claim 15, wherein the act of determining that the object has spatial frequency dominance in a first direction comprises the following:

an act of determining that the objects in a set of objects tend to have spatial frequency dominance in the first direction; and an act of determining that the object is one of the objects in the set of objects.

22. A computer program product in accordance with claim 15, wherein the object is a first object, the one or more computer-readable media further having thereon computer-executable instructions that, when executed by the one or more processors, further cause the computing system to perform the following:

an act of determining through computerized processing that a second object that is to be displayed adjacent to the first object has spatial frequency dominance in a second direction, wherein the second direction is perpendicular to the actual striping direction of the display device;

an act of performing sub-component based sampling assuming that the striping direction is parallel to the actual striping direction of the display device; and an act of rendering at least a derivative of the sampled representation of the second object on the display device having the actual striping direction.

23. A computer program product in accordance with claim 22, wherein the first and second objects are portions of the same Chinese pictograph.

24. A computer program product in accordance with claim 15, wherein the striping direction is vertical.

25. A computer program product in accordance with claim 15, wherein the striping direction is horizontal.

26. A computer program product in accordance with claim 15, wherein all of the pixels in the display have striping in the same direction.

27. A computer program product in accordance with claim 15, wherein the act of performing pixel sub-component based sampling assuming that the striping direction is perpendicular to the actual striping direction comprises the following:

an act of rotating the representation of the object;

an act of performing sub-component based sampling on the rotated representation of the object assuming the actual striping direction; and an act of rotating back the sampled representation of the object.

28. A computer program product in accordance with claim 27, wherein the act of performing pixel sub-component based sampling assuming that the striping direction is perpendicular to the actual striping direction further comprises the following:

an act of mapping the sampled values to a pixel sub-component.

29. A system, comprising a computing system that includes a display device having a plurality of pixels, for rendering an object on a portion of the display device that includes a plurality of pixel sub-components for each pixel, the plurality of pixel sub-components having an actual striping direction in a certain direction, and the system taking advantage of improved resolution due to sub-component based sampling which takes into account the relationship between the object and the actual striping direction of the display device, the system performing the method of claim 1.

30. The system of claim 29, wherein the step for rendering the object on the display device comprises the following:

an act of performing pixel sub-component based sampling assuming that the striping direction is perpendicular to the actual striping direction of the display device; and an act of rendering at least a derivative of the sampled representation of the object on the display having the actual striping direction.

31. The system of claim 30, wherein the act of performing pixel sub-component based sampling assuming that the striping direction is perpendicular to the actual striping direction comprises the following:

an act of rotating the representation of the object;

an act of performing sub-component based sampling on the rotated representation of the object assuming the actual striping direction; and an act of rotating back the sampled representation of the object.

32. The system of claim 29, wherein the object is a text character.

33. The system of claim 32, wherein the text character is a Latin-based text character.

34. The system of claim 32, wherein the text character is a pictograph of Chinese origin.

35. The system of claim 32, wherein the text character is a radical of a pictograph of Chinese origin.

36. The system of claim 29, wherein the object is not a text character.

37. The system of claim 29, wherein an act of determining that the object has spatial frequency dominance in a first direction comprises the following:

an act of determining through computerized processing that the objects in a set of objects tends to have spatial frequency dominance in the first direction; and an act of determining that the object is one of the objects in the set of objects.

38. The system of claim 29, wherein the object is a first object, the method further comprising the following:

an act of determining through computerized processing that a second object that is to be displayed adjacent to the first object has spatial frequency dominance in a second direction, wherein the second direction is perpendicular to the actual striping direction; and a step for rendering the second object on the display as appropriate given the spatial frequency dominance of the second object.

39. The system of claim 38, wherein the step for rendering the second object on the display as appropriate given the spatial frequency dominance of the second object comprises the following:

an act of performing sub-component based sampling assuming that the striping direction is parallel to the actual striping direction; and an act of rendering at least a derivative of the sampled representation of the second object on the display having the actual striping direction.

40. The system of claim 38, wherein the first and second objects are portions of the same Chinese pictograph.

41. The system of claim 29, wherein the striping direction is vertical.

42. The system of claim 29, wherein the striping direction is horizontal.

43. The system of claim 29, wherein all of the pixels in the display have striping in the same direction.

* * * * *